US005451929A

United States Patent [19]

Adelman et al.

[11] Patent Number: 5,451,929

[45] Date of Patent: Sep. 19, 1995

[54] SMOKE ALARM AND AIR CLEANING DEVICE

[75] Inventors: Roger Adelman; Donald G. Attermeyer, both of Cincinnati; Michael S. Duty, New Richmond, all of Ohio

[73] Assignee: Newtron Products Company, Cincinnati, Ohio

[21] Appl. No.: 7,668

[22] Filed: Jan. 22, 1993

Related U.S. Application Data

[63] Continuation-in-part of Ser. No. 724,872, Jul. 2, 1991, Pat. No. 5,182,542.

[51] Int. Cl.[6] ..... G08B 19/00

[52] U.S. Cl. ..... 340/521; 340/628; 340/627; 340/607; 340/500; 340/693; 340/586; 367/197; 55/213; 55/274; 165/11.1; 236/1 R; 236/21 R

[58] Field of Search ..... 340/500, 521, 628, 627, 340/693, 586, 607; 55/21, 213, 274, 270; 367/197–199; 236/1 R, 21 R; 165/11.1

[56] References Cited

U.S. PATENT DOCUMENTS

| | | | |
|---|---|---|---|
| 2,474,211 | 6/1949 | Cahusac . | |
| 3,369,346 | 2/1968 | Wildbolz et al. . | |
| 3,447,152 | 5/1969 | Jensen | 340/521 |
| 3,885,162 | 5/1975 | Geertz . | |
| 4,088,986 | 5/1978 | Boucher | 340/521 |
| 4,115,082 | 9/1978 | Newell | 55/103 |
| 4,446,454 | 5/1984 | Pyle | 340/531 |
| 4,642,128 | 2/1987 | Solorzano | 340/607 |
| 4,656,832 | 4/1987 | Yukihisa et al. | 340/628 |
| 4,747,364 | 5/1988 | Horowitz | 55/274 |
| 4,751,501 | 6/1988 | Gut | 340/607 |
| 5,231,378 | 7/1993 | Dennis et al. | 340/628 |
| 5,260,691 | 11/1993 | Shyu | 340/628 |

FOREIGN PATENT DOCUMENTS

| | | | |
|---|---|---|---|
| 0082396 | 3/1990 | Japan | 340/628 |
| WO90/10282 | 9/1990 | WIPO | 340/628 |

*Primary Examiner*—Donnie L. Crosland
*Attorney, Agent, or Firm*—Wood, Herron & Evans

[57] ABSTRACT

An air cleaner with a smoke alarm unit for a forced air recirculating system is disclosed. The smoke alarm unit is housed within a module that fits within the frame of the air cleaner with minimal impact on the cleaning ability of the cleaner. In a preferred embodiment of the invention, a battery capacity tester and air cleaner functionality detector are included in the module. Signals from the battery tester and functionality detector are used by the smoke alarm unit to drive an alarm generator with different signals to produce distinguishable alarms for a smoke condition, low battery condition, and an air cleaner failure. A control unit may receive any of the alarm conditions to execute different control actions in the forced air system.

25 Claims, 6 Drawing Sheets

SMOKE ALARM AND AIR CLEANING DEVICE

This is a continuation-in-part application of U.S. patent Ser. No. 07/724,872 filed Jul. 2, 1991, which will issue on Jan. 26, 1993 as U.S. Pat. No. 5 182,542, entitled "Smoke Alarm and Air Cleaning Device" which is hereby expressly incorporated by reference in the present application.

FIELD OF THE INVENTION

This invention relates to smoke detectors and air cleaning devices used in forced recirculating air conditioning systems.

BACKGROUND OF THE INVENTION

The use of smoke alarms in recirculating air conditioning systems is well known. The smoke alarms are normally mounted near or on the ceilings in various rooms serviced by the recirculating system or mounted adjacent to ducts within the system. When mounted in proximity to a duct, smoke alarms typically require an opening in the duct to sample the air or transmit some form of electromagnetic radiation through the air of the duct to detect smoke. While these types of smoke alarms are effective for generating alarms when smoke is detected in a room or duct, they usually require mountings, installation, and maintenance separate and distinct from the other components in the system.

For example, U.S. Pat. No. 3,369,346 shows a smoke alarm mounted in an auxiliary duct for a fiber carrying airstream. A portion of the fiber carrying airstream is diverted into the auxiliary duct so the smoke alarm can sense smoke in the diverted airstream. The smoke alarm of U.S. Pat. No. 2,474,221 uses reflected light to detect smoke within a duct. The smoke alarm of this '221 patent is mounted directly to the outside of one wall of the duct. An opening in the duct is required so a photoelectric sensor connected to the alarm can extend into the airflow. Light is injected into the duct through the opening by the alarm and the sensor detects reflected light from the particulate in the duct. The apparatus of U.S. Pat. No. 3,885,162 also uses optical techniques to detect smoke but does not include a sensor that extends into the airflow. Rather, a second opening is cut in the duct which opposes the light source of the alarm.

The operational components of the above described devices and other similar devices are mounted to the duct in a manner that facilitates their maintenance and keeps the components in a relatively clean operating environment. Environmental considerations for the electronics are important, for example, suspended particulate in the air flow may disable certain types of sensors by blocking the flow of air through the sensor. These and other requirements have placed limitations on the development of devices for smoke detection in domestic and industrial buildings.

There is a continuing need for improvements in a forced recirculating air conditioning system that detects smoke in the air flow promptly and effectively.

The smoke alarm and air cleaning device of U.S. patent Ser. No. 07/724,872 disclosed an integrated smoke alarm and air cleaner for use in a forced air recirculating system. One limitation of that device was the presentation of the air sample to the smoke detector within the module housing of that device. Specifically, air flow within the recirculating air system may affect the sensitivity of the smoke detector. Consequently, there is a need for controlling the rate of the air flow to the smoke detector within the module housing.

SUMMARY OF THE INVENTION

In accordance with the principles of the present invention, an air cleaning and smoke alarm apparatus is provided for a forced recirculating air conditioning system. The apparatus is located in the system to intercept all recirculating air within the system to clean the air and detect smoke. Thus, in contrast to known devices of the types described in the above background, the inventive device promptly samples all the air recirculating in the system for smoke detection. The device also enables a smoke detector and alarm to be installed in a very convenient manner in association with an air cleaner without special mountings or adaptations of conventional systems. Considerable economies are involved in the application of the principles of this invention.

In one form of the invention, the air cleaning and smoke alarm apparatus is provided as an integral unit. To achieve this end, a housing for a smoke alarm frictionally fits within the frame of an air cleaner mounted in a duct of a forced air system. One advantage of this apparatus is that it may be installed in proximity to the blower in the system that is located at the center or heart of the system to intercept all of the recirculating air in the system at one location.

In another form, the air cleaning and smoke alarm apparatus has an air cleaner that may be serviced to renew its air cleaning ability. To accomplish this object, a triboelectric air cleaner is used for the air cleaning device. One advantage of using a triboelectric air cleaner is its increased air cleaning effectiveness over that of passive air filters, such as those using spun glass, without the energy costs associated with active air cleaners such as electrostatic air cleaners.

In another alternative form, the smoke detector may be substituted with a carbon monoxide detector, natural gas detector, or radon detector. In fact, any sensor capable of detecting gas or particulate within the airflow of the system may be used since the integral air cleaner and detector unit is located at a central location within the system.

Another object of the present invention is to make the air cleaning and smoke alarm device free of any external electrical connections for its operation. To this end, the smoke alarm of the apparatus is powered by a battery which may be mounted within the smoke alarm housing.

The components of the apparatus may be monitored to detect their deterioration before complete failure. To achieve this end, an air cleaner functionality detector and a low battery detector are provided in the apparatus. The air cleaner functionality detector is mounted in proximity to the air cleaner to detect diminished air flow through the air cleaner. In a preferred embodiment of the invention, a pressure differential switch compares the difference in air pressures on the upstream and downstream sides of the air cleaner to a predetermined threshold to monitor the air cleaner. The low battery detector periodically tests the energy capacity of the battery to determine whether it retains sufficient energy to reliably operate the apparatus. Both the cleaner functionality and low battery detectors are connected to the alarm generator for the smoke to generate different alarms in response to either detected condition. One advantage of this device is the elimination of redundant alarm generators for each type of detector.

In another embodiment of the invention, the functionality detector or the air cleaner includes a pressure sensor and a memory element. At installation, the detector reads the pressure differential across the air cleaner sensed by the sensor a predetermined number of times and calculates an average of the readings to establish a reference differential pressure. The functionality detector calculates a dirty filter threshold value by adding a predetermined differential pressure value to the reference differential pressure and stores the calculated threshold value in the memory element. When the pressure sensor senses a differential pressure corresponding to the stored predetermined threshold value, the detector provides a signal to the alarm generator which in turn generates an alarm indicative of the functional failure of the air cleaner.

In another embodiment, the functionality detector provides a signal to the alarm generator alter the expiration of a predetermined time interval. The predetermined time interval is selectively set by the user and measurement of the predetermined time interval commences with the installation of the integral functionality detector and smoke alarm unit. Once the predetermined time interval expires, the functionality detector provides a signal to the alarm unit which sounds an audible alarm to attract attention.

In another embodiment of the invention, the housing encloses a receptacle in which a functionality detector, a smoke detector, and a power source are mounted. The housing has a front surface, a rear surface, and an edge interposed between the front and rear surfaces and the front and rear surfaces are adapted to be engaged within a frame of an air cleaner. An airflow path is provided through the housing into the receptacle so that an air sample is provided to the smoke detector and the pressure differential across the air cleaner may be sensed. The airflow path includes a stall chamber and an expansion chamber to control the velocity of the airflow prior to entering the receptacle. The controlled airflow rate presents an air sample to the smoke detector at a rate within a range suitable for its effective operation.

Preferably, the stall chamber communicates with air flowing through the air cleaner via an inlet. Passageways lead from the stall chamber to an expansion chamber. Preferably, the passageways have a total cross sectional area greater than the inlet and are U-shaped. The expansion chamber permits the air to expand and enter the receptacle at a reduced airflow rate. The reduced airflow rate presents particulate to the smoke detector so it may be properly sensed.

It is also an object of the present invention to control the recirculating air conditioning system with the air cleaner and smoke alarm device. To this end, the smoke detector generates a control signal that causes an action within the system, such as shutting off the blower or closing a ventilation opening when smoke is detected in the air flow. One advantage of this system is its ability to react to a fire situation by changing airflow conditions which may be contributing to the fire.

Another embodiment of the present invention provides a furnace controller that responds to the audible alarms generated by the smoke alarm unit of the present invention. The controller includes a sensor, a filter circuit, a discriminator circuit, and a control circuit. The sensor receives the acoustical alarms generated by the controller and converts the acoustical alarm to an electrical signal. The electrical signal is filtered to generate a filtered electrical signal when the acoustical signal has frequency components in the range of the acoustical alarms from the smoke alarm unit which have an amplitude above a predetermined threshold. The discriminator circuit determines the duration of the filtered electrical signal to distinguish the low battery, air cleaner failure, and smoke alarms generated by the smoke alarm unit. The control circuit responds to a signal by identifying the type of alarm received from the smoke alarm unit and by performing a control action corresponding to the type of alarm. For example, the control circuit removes electrical power to the furnace in response when a smoke alarm sounds for an appropriate duration.

Other features, objects and advantages of the present invention shall be made apparent from the accompanying drawings and the following detailed description thereof.

BRIEF DESCRIPTION OF THE DRAWINGS

The accompanying drawings, which are incorporated and constitute a part of the specification, illustrate a preferred embodiment of the invention and, together with the general description given above, and the detailed description of the embodiment given below, serve to explain the principles of the invention.

DETAILED DESCRIPTION OF THE PREFERRED EMBODIMENT

Figure 1:
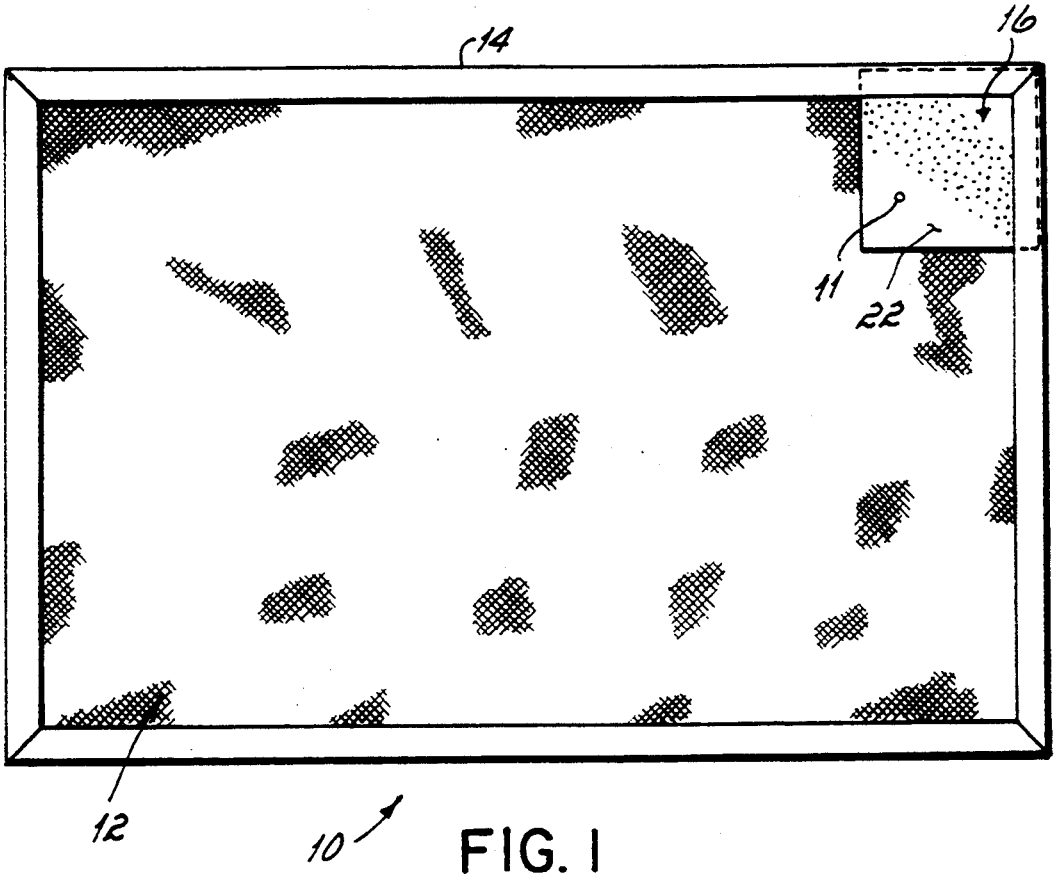
FIG. 1 is a plan view of a smoke detector and air cleaning apparatus built in accordance with the principles of the present invention.

A preferred embodiment of an air cleaner constructed in accordance with the principles of the present invention is shown in FIG. 1. Cleaner 10 includes an air cleaner 12 mounted within a frame 14 with a smoke alarm module 16 partially exposed in one corner thereof. A pressure opening 11 is located in cover plate 22 of module 16 that faces the airflow within the duct of a forced air recirculating system.

Figure 2:
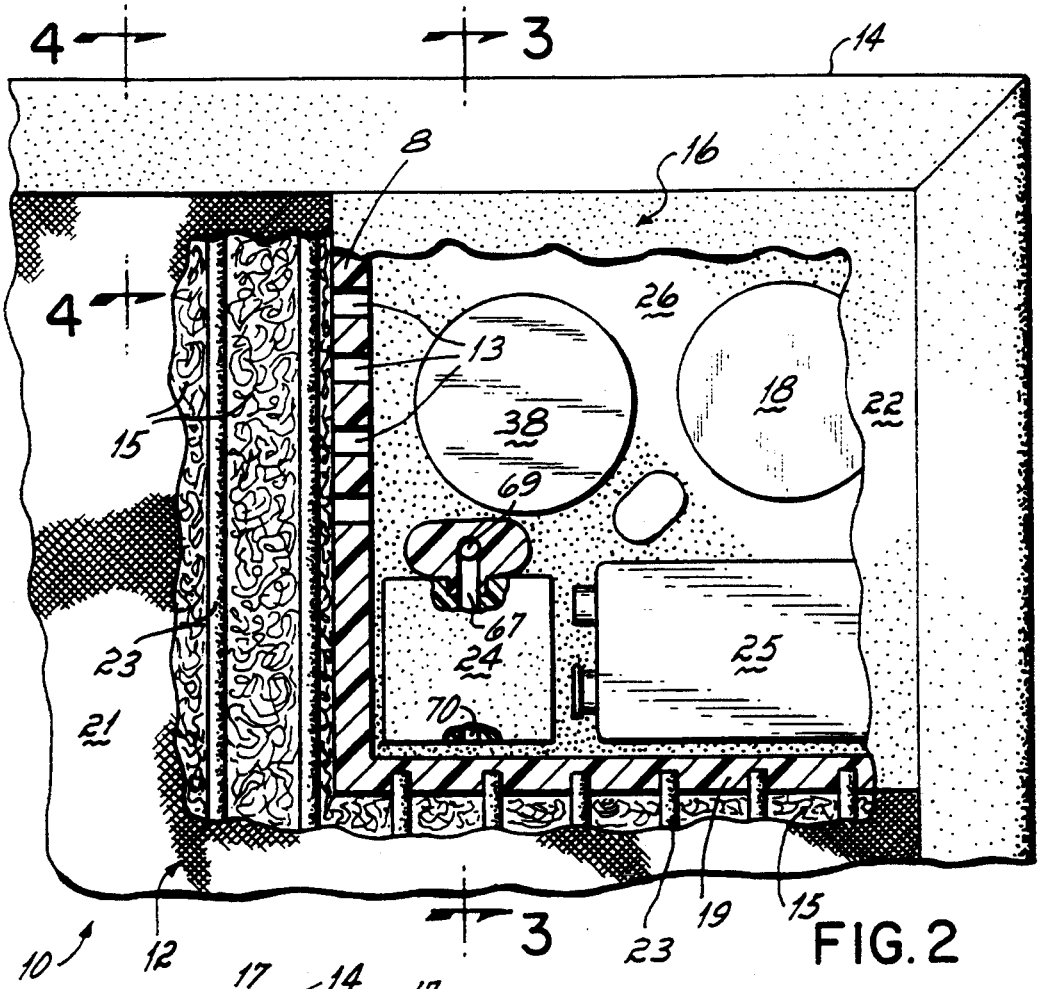
FIG. 2 is an enlarged fragmentary view, partially in cross-section, of the upper right hand corner of the apparatus shown in FIG. 1.

Module 16 is shown in FIG. 2 with cleaner 12 and cover 22 partially broken away to reveal smoke alarm unit 18, smoke sensor 38, battery 25, LED 126 and cleaner functionality detector 24. These components are mounted to mounting plate 26.

In the preferred embodiment of the present invention, air cleaner 12 is a triboelectric air cleaner such as that disclosed in U.S. Pat. No. 4,115,082 which is assigned to the assignee of the present application. The disclosure of that patent is hereby explicitly incorporated by reference in this application. Although cleaner 12 is preferably a triboelectric cleaner, other filters and cleaners maybe used such as passive fiber filters or electrostatic cleaners. Cleaner 12 has a fibrous layer 21 that overlies cleaning media 15 and rods 23 that are inserted in bottom wall 19 of cover 22.

Ventilation openings 13 in side wall 8 of cover 22 permit air to flow from cleaner 12 into module 16, through smoke sensor 38, and exit via grille 61 (FIG. 3) in plate 26. Pressure intake 67 of functionality detector 24 intersects conduit 69 leading from pressure opening 11 in cover 22 to provide the intake sample. Opening 11 is sealed with a grommet or the like to prevent air from entering module 16 through the opening. Reference pressure intake 70 is open to sample the pressure within module 16. The relative air tightness of module 16 permits functionality detector 24 to sample the air impinging on the upstream side of cleaner 12 and the air in module 12 that has passed through cleaner 12. The relative difference between these two samples is indicative of the functionality level of cleaner 12. This is done without blocking the air through sensor 38 that permits it to detect smoke in the duct.

In the preferred embodiment of the invention represented in FIG. 2, functionality detector 24 is a pressure differential switch which samples the air pressure on the upstream and downstream side of cleaner 12. Switch 24 generates a signal when the pressure difference between the upstream and downstream side of cleaner 12 exceeds a predetermined threshold. The switch can be selectively set at different predetermined thresholds so the cleaner can be configured for use in different systems. Such switches are well known within the art. The signal generated by the switch 24 when the threshold pressure is exceeded activates a cleaner functionality alarm generating circuit.

While the preferred functionality detector is a pressure differential switch, other devices that measure a property of the air that differs on either side of cleaner 12 because of the action of cleaner may be used. For example, a device that measures the amount of particulate remaining in the air after passing through the cleaner may be used. For another example, the functionality detector 24 may be a pressure transducer which is interfaced with a memory element. At the installation of the module 16 in the air circulating system, the pressure transducer measures the pressure differential across the air cleaner 12 for a predetermined number of times and calculates an average to establish a differential pressure reference. A predetermined pressure differential value corresponding to an increase in pressure across the cleaner 12 that indicates a functionality failure is added to the differential pressure reference to establish a threshold value which is stored in the memory element. The pressure transducer generates a signal to activate a functional alarm when the pressure differential value sensed across the cleaner 12 is approximately equal to or greater than the predetermined threshold value.

Figure 3:
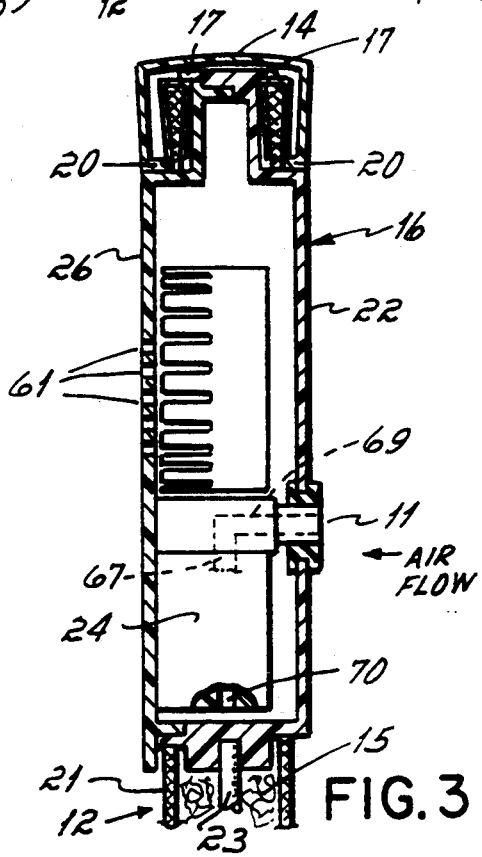
FIG. 3 is a cross-sectional view taken on line 3—3 of FIG. 2.
Figure 4:
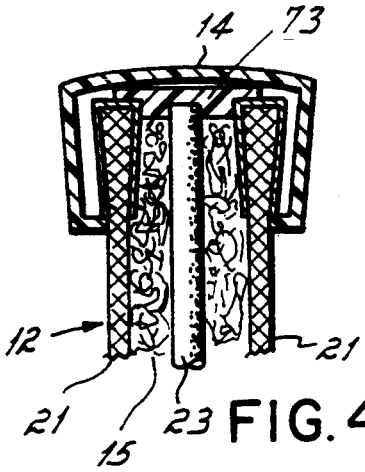
FIG. 4 is a cross-sectional view taken on line 4—4 of FIG. 2.

As shown in FIG. 3, mounting plate 26 snaps within cover 22 so plate 26 and the mounted components may be removed from device 10 so air cleaner 12 can be cleaned. Mounting flange 17 formed by cover 22 and plate 26 is captured between channels 71, which hold the front and rear fibrous layers 21 of cleaner 12, and flanges 20 of frame 14. FIG. 4 shows the construction of cleaner 12 in the area outside module 16. Channels 71 are clamped over a fibrous layer and placed on either side of cleaning media 15. Rods 23 are secured within member 73 and extend downwardly through media 15.

The apparatus constructed in accordance with the principles of the present invention minimizes the area of the air cleaner affected by the installation of module 16 so the operational life of the cleaner is virtually unaltered. This is accomplished by reducing the size of module 16 that extends beyond frame 14 so it constitutes a negligible portion of the surface area of the media used in cleaner 12. In the preferred embodiment of the invention, the surface area of media 12 is approximately 400 square inches and the surface area of module 16 is approximately 12 square inches.

The housing of module 16 is also ventilated with openings 13 and grille 61 that permit the flow of air through the module. The section of cleaner 12 adjacent openings 13 clean the flow of air through module 16 that aids in dissipating heat from the electronic components and that provides the smoke sensor with air to sample for smoke particulate. Thus, the operating environment within module 16 is not destructive to the components and the air cleaner efficiency is relatively unaffected.

The components of smoke alarm module 16 are integrated with the cleaning function of cleaner 12 to make device 10 a cohesively functional unit. Cleaner 12 provides an airflow through module 16 that reduces the harshness of the duct environment to electronics and smoke sensors. The effectiveness of the cleaner is monitored by functionality detector 24 that detects the functional degradation of the cleaner before the environment within module 16 is adversely affected. Smoke alarm unit 18 periodically tests battery 25 by connecting LED 126 as a test load and determines the battery capacity. Smoke alarm unit 18 also provides an alarm actuator that generates an alarm for service personnel when cleaner 12 or the power source for module 16 are failing functionally.

As shown by FIGS. 1, 2 and 3, module 16 does not alter the dimensions of the air cleaner used in device 10. Thus, the device may be slid into and removed from a filter mounting slot in a typical duct of a forced recirculating air conditioning system. The mounting of module 16 within cleaner 12 and frame 14 eliminates the need for special access openings and external mounting structures.

Figure 8:
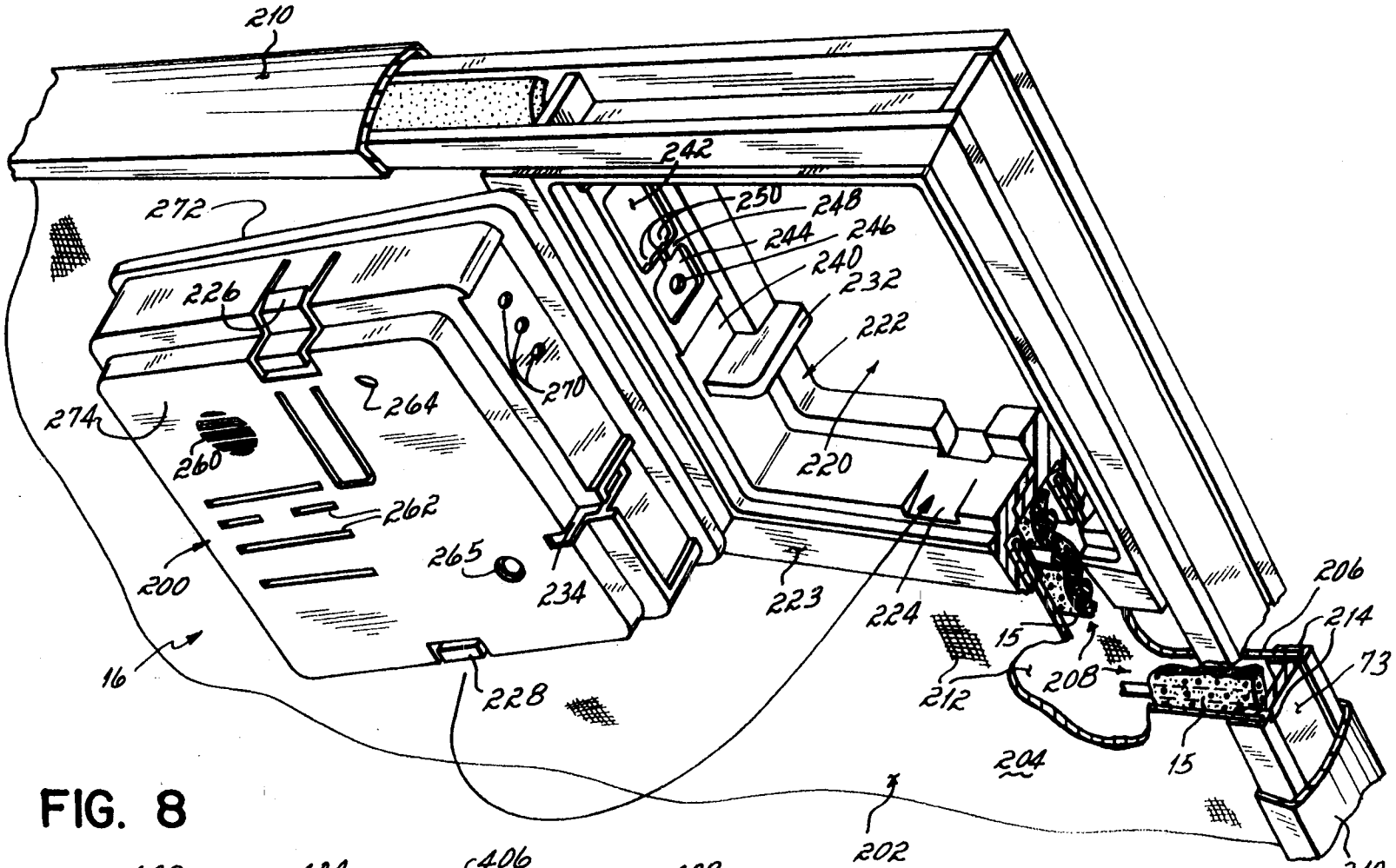
FIG. 8 is a perspective view of an embodiment of the module housing of the apparatus of FIG. 1 demonstrating how the housing fits within the air cleaner frame.

FIG. 8 shows the interconnection of an embodiment of a housing 200 of module 16 in a frame sleeve 210 of an air cleaner 202. The air cleaner 202 is preferably of the triboelectric type previously discussed and includes a front filter 204, rear filter 206, and preferably an electrostatic rod assembly 208 held together by a frame sleeve 210. The filters 204, 206 are made from polymeric sheets 212 which are gripped at their outboard edges by a U-shaped channel 214. Using like numbers for elements discussed with reference to other Figures, the electrostatic rod assembly 208 includes a framing member 73 in which the ends of the electrostatic rods 23 are secured. Interposed between and about the electrostatic rods 23 is the cleaning media 15. To form the air cleaner 202, the electrostatic assembly 208 is placed between the front and rear filters 204, 206 and the frame sleeve 210 is frictionally snapped about U-shaped channels 214 to secure the filters about the assembly 208.

An opening 220 is provided in one corner of the triboelectric air cleaner 202 shown in FIG. 8. Mounted within the opening 220 is a mounting sleeve 222 having a front flange 223 and a rear flange (not shown) that are gripped by the biasing action of the sleeve 222 against the U-shaped channels 214. Preferably, front flange 223 is not as wide as the rear flange so air flowing past the front flange is blocked by the rear flange near the edges of the module housing 200 adjacent the cleaning media 15. The mounting sleeve 222 includes an upper (not shown) and a lower indent 224 in which biasing members 226 and 228, respectively, reside when the module housing 200 is placed within the opening 220. Key 232 is provided along one side of the mounting sleeve 222 to activate a reset switch for the module electronics when the module is installed within the air cleaner 202. Key 232 also prevents the improper placement of the module housing 200 within the opening 220 because slot 234 that receives key 232 is only provided along one side of module housing 200.

Located in the edge 240 of the mounting sleeve 222 is an expansion chamber 242. Expansion chamber 242 is cut into edge 240 with the dimensions of approximately 0.8" by 0.5". Also provided in edge 240 is an air stall chamber 244. Air stall chamber 244 communicates with the fibrous media 15 in the air cleaner 202 by means of an inlet 246. The inlet 246 is preferably at a diameter of 0.160" and the air stall chamber 244 preferably has the dimensions of 0.4" by 0.5". Both the air stall chamber and the expansion chamber have a depth of approximately 0.080". Cut within bridge 248 which separates stall chamber 244 from expansion chamber 242 are a plurality of passageways 250. These passageways are preferably sized such that the totality of their cross sectional areas is greater than the cross sectional area of inlet 246 to expand the airflow volume and reduce the airflow velocity from the stall chamber 244 to the expansion chamber 242.

Module housing 200 encloses a receptacle in which a functionality detector such as a pressure differential transducer, a smoke detector, a piezo electric buzzer, and a power source such as an alkaline battery are mounted as an integral unit. The slotted opening 260 is provided behind a resonating chamber (not shown) in the rear surface of module housing 200 to emit a sound generated by the piezoelectric buzzer. The horizontal slots 262 are provided in the vicinity of the pressure differential transducer so air may flow through the module housing 200, preferably, past the smoke sensor 38 for sampling purposes and exit in the vicinity of the pressure differential transducer so a pressure difference across the air cleaner may be sensed. Aperture 264 is provided in the rear of module housing 200 so an LED on a circuit board within the housing may be viewed. The LED periodically loads the battery to verify battery operation and residual capacity. Preferably, the LED loads the battery approximately at 40 second intervals for 10 milliseconds at 10 milliamps, and provides a visual verification that the battery is still operational. Aperture 265 provides access to a threshold adjustment for the pressure differential transducer.

Air entry ports 270 are provided along the edge of the module housing 200 between its front surface 272 and rear surface 274. These entry ports are placed in the edge of the module housing 200 so they communicate with the expansion chamber 242. Thus, when the module housing 200 is inserted within mounting sleeve 222 and the biasing tabs 226, 228 are released into the latching position, the module housing 200 is held within mounting sleeve 222.

With the module housing 200 latched within the mounting sleeve 222, air passes through the front filter 204 of air cleaner 202 and into the cleaning media 15. The air from media 15 enters inlet 246 because there is a pressure differential between the air within the cleaning media 15 and the air within housing 200. The air entering the inlet 246 impinges on the floor formed in the stall chamber 244 and passes through the passageways 250 to enter the expansion chamber 242. The stall chamber 244 and passageways 250 reduce the amount of heavy particulate in the airflow which may erode the effectiveness of the smoke sensor of the smoke detector if it were otherwise permitted to enter the housing 200. The expansion chamber 242 reduces the rate of air flow within the chamber 242 so the remaining particulate is presented to the smoke detector in a manner effective for sensing. The pressure gradient between the higher pressure air within module housing 200 and lower pressure air in the expansion chamber 242 moves air through the entry ports 270 and into the receptacle enclosed in the module housing 200. The air continues past the smoke detector 38 and exits the receptacle of the module housing 200 through the horizontal slots 262 in the rear surface 274 of the module housing.

Clearly, the module housing constructed in accordance with the principles of the present invention integrates an air cleaner and electronics unit so the housing of the electronics may be removably mounted within the air cleaner without interfering with the cleaning of the air flow. Thus, the module housing and electronics may be selectively removed for the servicing of the air cleaner. In an alternative embodiment, the air entry ports, air stall chamber, constricted passageways, inlet chamber and inlet may be integrally formed in the edge of the module housing 200.

Figure 5:
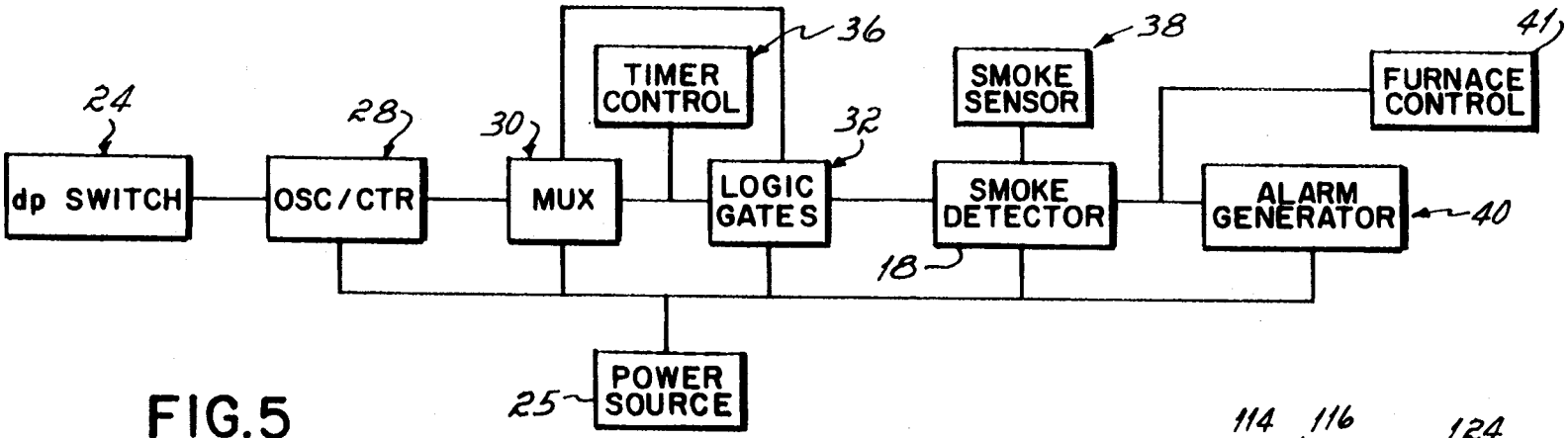
FIG. 5 is a block diagram depiction of the electronic circuitry in the invention.

A block diagram of the electronics within the smoke alarm module 16 is shown in FIG. 5. The electronic components of the smoke alarm module are powered by a power source 25, which in the preferred embodiment of the invention is a 9 volt dry cell battery. Functionality detector 24 along with the cleaner functionality alarm generating circuit components—counter 28, multiplexer 30, logic gates 32, and timer control 36—provide a signal to smoke alarm unit 18 which indicates the functionality of the air cleaner has fallen below a predetermined threshold. Smoke alarm unit 18 drives alarm generator 40 in response to a signal from the cleaner functionality alarm generating circuit, a smoke detected signal from sensor 38, and a low battery signal. In the preferred embodiment of the invention, the alarm generator driving signal varies the alarm generated from each signal.

Functionality detector 24 generates a signal when the effectiveness of cleaner 12 falls below a predetermined threshold. The signal activates oscillator/counter 28, which internally generates a timing signal which is counted by a binary counter within the integrated circuit. Binary digits from the counter output are provided to multiplexer 30 which selects predetermined digits of the counter output to pass to logic circuit 32. Logic circuit 32 sends a cleaner failure signal to smoke detector 18 in accordance with the digits passed by multiplexer 30. Logic circuit 32 also sends control signals back to multiplexer 30 which select the binary digits of the counter output that are passed through multiplexer 30. The timing duration of the cleaner failure signal to smoke alarm unit 18 is determined by timer control 36. The repetition rate of the cleaner failure signal is determined by the binary counter digits passed through multiplexer 30.

Smoke alarm unit 18 performs three functions—smoke detecting, battery capacity testing, and alarm driving. Smoke alarm unit 18 detects smoke particulate in the air flow through sensor 38 of module 16. Power from source 25 is periodically monitored within smoke alarm unit 18 to determine if the capacity of source 25 has fallen below a predetermined level when smoke is detected or the battery capacity falls below the predetermined level, smoke unit 18 drives alarm generator 40 with a driving signal to generate an audible alarm or report. Unit 18 produces one driving signal when smoke is detected and a second driving signal when the battery is low so the alarms generated from the two driving signals are distinguishable from one another.

The cleaner failure signal from logic circuit 32 has its frequency and duration altered by timer control 36 and the timing digits passed by multiplexer 30. The cleaner failure signal modifies the reference voltage that unit 18 uses to detect a smoke condition from sensor 38. Altering the reference voltage causes unit 18 to generate a smoke alarm driving signal but the duration and repetition of the cleaner failure signal controls the duration and repetition of the generated alarm. Thus, the resulting alarm or report is distinguishable from both the smoke alarm and low battery alarm. By driving alarm generator 40 with different signals, the service personnel can distinguish between a smoke alarm, low battery alarm, and a cleaner functionality failure alarm.

In the preferred embodiment of the present invention, smoke alarm unit 18 is a Jameson Code One-2000 Model C manufactured by Jameson Home Products of Downers Grove, Ill. The unit uses a Motorola 14467-1 integrated circuit manufactured by Motorola, Inc. of Phoenix, Ariz. The smoke alarm unit of the preferred embodiment uses an ionization sensor to detect smoke in the air flow of the duct. Other smoke alarm units may be used that utilize other smoke detection methods such as optical sensors or the like.

The integration of the functionality alarm with the smoke alarm made possible by varying the alarm driving signal from unit 18, contributes to the downsizing of module 16 since redundant alarm generators are eliminated. The reduced package size eliminates false smoke alarms caused by the accelerated deterioration of the cleaning media. Blockage of a large area increases the cleaning requirements for the unblocked portion of the cleaner and decreases the operational life of the media. Without more frequent servicing, the air is not cleaned as well and the amount of particulate remaining in the air increases. This increased particulate may be sensed as smoke by the detector which erroneously generates a smoke alarm. These false alarms are virtually eliminated by the minimal impact module 16 has on the area of cleaner 12 and by cleaner maintenance performed in response to the cleaner functionality alarms generated by the present invention.

Other embodiments of the smoke alarm module 16 may be constructed by substituting other types of air quality alarm units for the smoke alarm unit 18. For example, smoke alarm unit 18 may be replaced by a radon alarm unit, a carbon monoxide alarm unit or a natural gas alarm unit. All that is required for the air quality detector is a suitable sensor that generates a signal in response to the detection of a particulate or gas in the air flow through the module and an alarm generator that responds to the detection signal from the sensor.

Furnace control 41 of FIG. 5 operates elements of the furnace in the forced air system using the cleaning device of the present invention. These control operations may be performed by control 41 in response to the wiring of the alarm driving signal to control 41, the detection of an acoustical signal generated by alarm generator 40, or the transmission of an alarm signal by a radio transmitter or the like connected to the alarm driving signal. Control 41 may include a computer operated control system or a simple relay that is energized by the signal. Control 41 may close ventilation openings, shut off the blower, divert airflow through different ducts or other system related actions.

Figure 7:
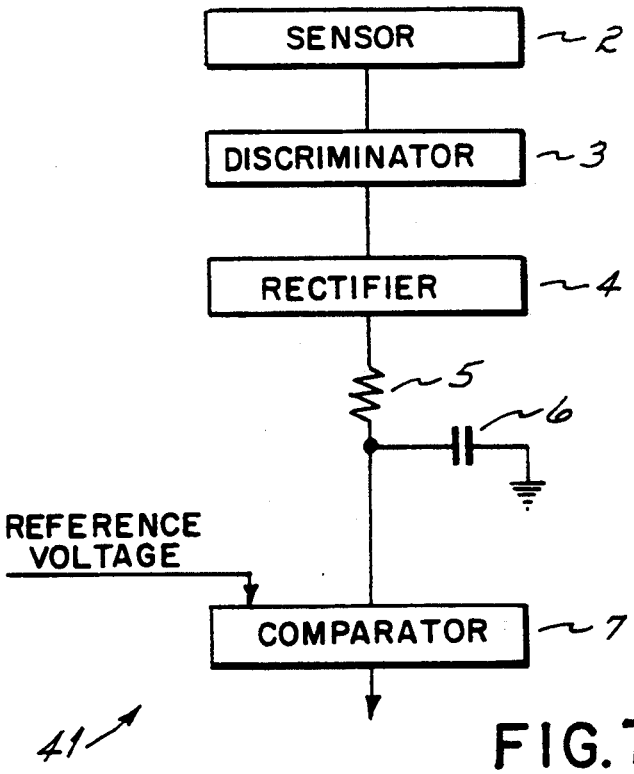
FIG. 7 is a block diagram of a control signal generator.

A block diagram of a preferred furnace control signal generator is shown in FIG. 7. A sensor 2 detects a signal such as, the alarm driving signal, an acoustic alarm, radio signal or the like. A discriminator 3 verifies that the signal is indicative of a condition detected by device 10 that requires a control action. A plurality of discriminators may be used to distinguish the different types of alarms from one another and execute different control actions for each type of alarm. The discriminated signal is rectified by full wave rectifier 4 and fed by resistor 5, capacitor 6 combination to a comparator 7. The resistor-capacitor combination requires the received signal to be present for at least one charging time constant to prevent control actions from transient signals. Comparator 7 compares the signal to a reference voltage and generates a control signal when it is greater than the reference voltage. The control signal may then be used to close a relay, interrupt a control processor, or the like. For example, the control signal could energize a relay to open or close an input power connection to an output power connection.

Figure 9:
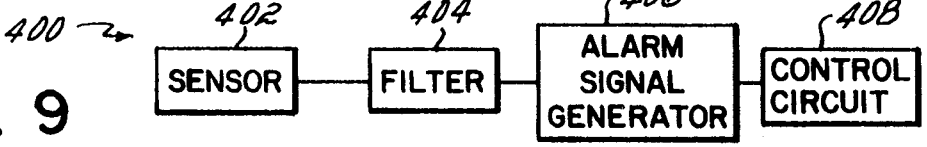
FIG. 9 is a block diagram depiction of an embodiment of a furnace controller that operates in accordance with the principles of the present invention.

A block diagram of an embodiment of a furnace controller responsive to an acoustic alarm built in accordance with the principles of the present invention is depicted in FIG. 9. The controller 400 includes a sensor 402, a filter circuit 404, an alarm signal generator 406 and a control circuit 408. The sensor 402 receives an acoustical signal and converts it into an electrical signal. The filter circuit 404 attenuates the frequency components of the electrical signal from the sensor 402 so the amplitude of the filtered electrical signal is above a predetermined threshold in response to an acoustical signal having frequency components in the range of the acoustical alarm generated by the smoke alarm module 16. The alarm signal generator 406 determines whether the duration of the filtered electrical signal corresponds to that of valid acoustical alarm generated by the smoke alarm module 16. If the alarm signal generator 406 determines a valid acoustical alarm has been received then an alarm signal is generated which is coupled to the control circuit 408 which performs a control action with respect to the operation of the furnace.

Figure 10:
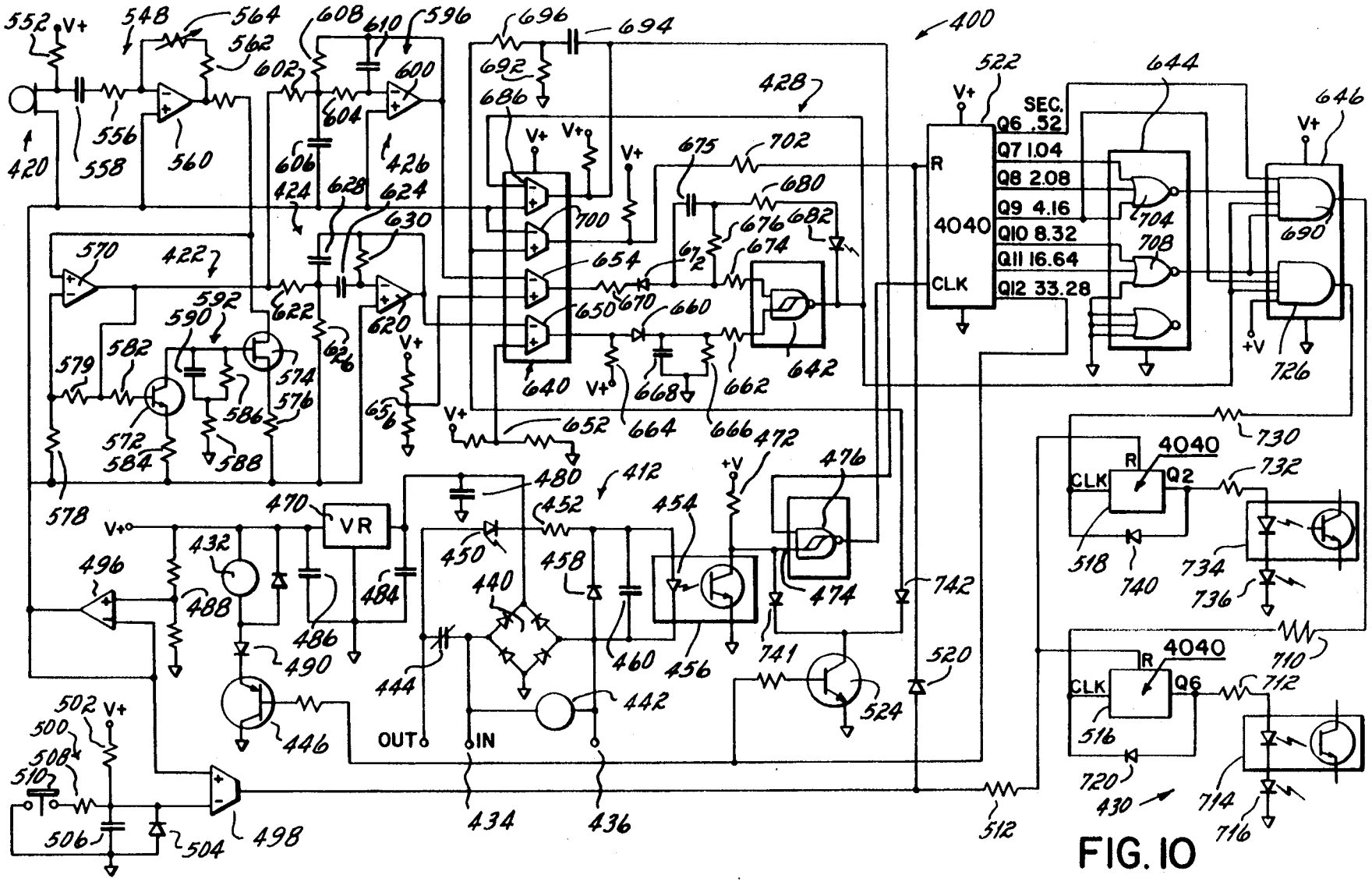
FIG. 10 is an electrical schematic diagram of the circuitry used to implement the furnace controller shown in FIG. 10.

An electrical schematic of a preferred embodiment of the furnace controller 400 is shown in FIG. 10. Generally, the controller 400 includes a power supply 412, a microphone 420, an automatic gain control circuit (AGC) 422, a band pass filter 424, a low pass filter 426, a discriminator circuit 428 and a control circuit 430. Microphone 420 receives an acoustic signal and converts it to an electrical signal which is amplified by the AGC circuit 422. The amplified electrical signal is filtered by the bandpass filter 424 which produces a filtered electrical signal corresponding to an amplified electrical signal having frequency components within a predetermined range. The amplified electrical signal is also filtered by the lowpass filter 426 which produces a filtered electrical signal corresponding to an amplified electrical signal having frequency components which are less than a predetermined frequency.

The discriminator circuit 428 generates an alarm signal in response to a filtered electrical signal from the bandpass filter 424 which is greater than a predetermined threshold and a filtered electrical signal from the lowpass filter 426 which less than the predetermined threshold. Additionally, the discriminator circuit 428 has a binary counter 522 which is used to verify the filtered electrical signals are at the above described states for a predetermined time before generating the alarm signal to verify receipt of a valid acoustical alarm from the smoke alarm module 16. The control circuit 430 selectively de-energizes the coil 432 of a relay which terminates the flow of power to the furnace in response to a smoke alarm and provides a visual indication of a low battery condition and dirty filter condition at LEDs 716 and 736, respectively.

With further reference to FIG. 10, power supply 412 receives power from the transformer (not shown) of the furnace. The secondary high tap 434 and secondary low tap common connection 436 from the transformer are coupled to the inputs of a full wave rectifier 440. A Metal Oxide Varistor (MOV) 442 such as a Panasonic ZNR-1 may be coupled between the high secondary tap 434 and the low secondary tap common connection 436 of the transformer to suppress noise in the input power to the supply 4 12. The high secondary tap 436 of the transformer is coupled through normally closed contacts 444 to power the furnace. Control of the coil 432 via transistor 446 of the control circuit 430 opens the contacts 444 to remove power from the furnace in response to a valid smoke alarm signal as discussed in more detail below.

The secondary high tap 434 of the transformer is coupled through the contacts 444, LED 450 and resistor 452 to the anode of a diode 454 within opto-coupler 456. The cathode of diode 454 is coupled to the common connection 436 from the transformer and one of the inputs to the full wave rectifier 440. A diode 458 and a capacitor 460 are coupled between the resistor 452 and the common connection 436 of the transformer. Two things are accomplished by this circuit. First, the input of the transformer power to the full wave rectifier 440 provides a rectified DC output to the input of a voltage regulator 470. Secondly, the AC input of the transformer power through the diode 454 of the opto-coupler 456 provides a periodic signal to the base of the transistor of the opto-coupler 456. This causes the transistor of the opto-coupler 456 to conduct the power supply voltage +V to electrical ground through resistor 472 in synchronization with the signal through the diode 454 of the opto-coupler 456. The operation of the optocoupler 456 produces a clock signal at the input 474 of Schmitt trigger NAND gate 476 for purposes discussed below. Preferably the transformer supplies 24 VAC at a frequency of 60 Hz, although other voltages and frequencies are possible. Thus, once power from the transformer is applied to the controller 400 and the contacts 444 close, a 60 Hz clock signal is provided to the NAND gate 476. Additionally, the frequency of the transformer input alternately conducts through the LED 450 to provide a visual indication that the furnace controller 400 is operating.

The full wave rectified power from the rectifier 440 is smoothed by capacitor 480 and coupled to voltage regulator 470. Capacitors 484, 486 are coupled between the input and output of the regulator 470 and electrical ground, respectively, to suppress high frequency noise. The regulated voltage output of the regulator 470 is coupled to relay coil 432, voltage divider 488 and to other components in the controller 400 as power supply V+. The relay coil 432 is coupled through a diode 490 and a PNP transistor 446 to electrical ground such that when transformer power is applied, coil 432 is coupled to ground because the signal at the base of the transistor 446 is a logic low. Thus, coil 432 is energized and the contacts 444 close to provide transformer power to the furnace and to the opto-coupler 456. The output of the voltage divider 488 provides a reference voltage, approximately half of the regulated DC voltage V+, to the non-inverting input of the operational amplifier 496. The amplifier 496 is configured as a voltage follower so that its output is maintained at a level approximate that of the voltage divider 488 over a wide range of low level current. The output of the amplifier 496 thus provides a virtual ground reference to the electrical components in the sensor, AGC, and filter circuits. Provision for such virtual ground permits the operational amplifiers of the sensor, AGC, and filter circuits to be coupled to AC signals such that the outputs of all the amplifiers are centered at the midpoint voltage in the DC voltage range of the power supply 412.

Again with reference to FIG. 10, the virtual ground from the output of the amplifier 496 is also coupled to the non-inverting input of comparator 498 which has its inverting input coupled to an external reset circuit 500. The regulated voltage V+ is provided through resistor 502 to the inverting input of the comparator 498, the cathode of a diode 504, one side of capacitor 506 and a resistor 508 which is coupled to electrical ground through a momentary switch 510. When the controller 400 is first powered, the regulated voltage V+is provided to the inverting input of the comparator 498. As long as this voltage remains at the inverting input of the comparator 498, the output of the comparator remains a logical low. When the momentary switch 5 10 is depressed, the V +voltage is dropped across a voltage divider comprised of resistors 502 and 508 so that the voltage supplied to the inverting input of the comparator 498 changes. Resistor 508 is significantly smaller than resistor 502 so the voltage at the inverting input is very close to zero when switch 5 10 is depressed. When this occurs, the output of the comparator 498 goes high to provide a reset pulse. The reset pulse is coupled through resistor 512 to reset the counters 516, 518, and through diode 520 to reset binary counter 522.

With reference to FIG. 10, the sensor circuitry 548 is discussed in more detail. The sensor is preferably a electret microphone 420 manufactured by Panasonic of Japan and is designated as Part No. WM54GT. The voltage V+is supplied to the microphone 420 through a resistor 552. The sensor circuitry 548 converts an acoustical signal received by the microphone 420 to an electrical signal which is amplified by the amplifier 560 and provided to an AGC circuit 422. The microphone 420 is also preferably coupled to virtual electrical ground to reduce noise induced by ground currents whenever microphone 420 is coupled to electrical ground and the other components of the sensor circuitry are coupled to virtual ground. Microphone 420 converts an acoustical signal to an electrical signal that is conditioned by the resistor and capacitor combination 556 and 558. The conditioned electrical signal is coupled to the inverting input of amplifier 560. The non-inverting differential input of the amplifier 560 is coupled to the virtual ground. The output of the amplifier 560 is fedback to its inverting input through resistor 562 and variable resistor 564. By varying the resistor 564 the gain through the amplifier may be adjusted to set a primary sensitivity threshold for the sensor circuitry 548 yet additional, automatic gain control is provided by means of AGC circuit 422.

The output of the amplifier 560 is provided to the AGC circuit 422. The AGC circuit 422 includes operational amplifier 570 and transistors 572 and 574. Preferably, transistor 572 is a PNP transistor and transistor 574 is a JFET transistor. The output of the operational amplifier 560 is coupled to the non-inverting input of the operational amplifier 570 and to the drain of the transistor 574. The source of transistor 574 is coupled to the virtual ground through a limiting resistor 576. The inverting input of the amplifier 570 is coupled to the virtual ground through resistor 578 and a feedback resistor 579 is provided between the output of the amplifier 570 and the junction of the resistor 578 and the inverting input of the amplifier 570. The divided circuit so formed by resistor pairs 579 and 578 sets the primary gain for the amplifier 570. The output of the amplifier 570 is also coupled to the base of the transistor 572 through a resistor 582. The collector of the transistor 572 is coupled to the virtual ground through resistor 584 and the emitter of the transistor 572 is coupled to the gate of transistor 574. The resistors 586, 588 and capacitor 590 form a network 592 which is coupled between electrical ground and the emitter to gate coupling of the transistors 572, 574 to cooperate with transistor 572 in the control of transistor 574.

The AGC circuit 422 amplifies the output of the amplifier 560 in accordance with the voltage divider formed by resistors 579 and 578 and attenuates its own input under the control of the transistors 572 and 574. Specifically, the output of the amplifier 570 provided to the base of the transistor 572 normally causes the transistor 572 to conduct and couple the gate of the transistor 574 to the virtual ground. In this state, transistor 574 does not conduct and transistor 574 acts as a high impedance to virtual ground for the output of amplifier 560 so the input to amplifier 570 is virtually unaffected. As the output of amplifier 570 increases, transistor 572 decreases in its coupling of the gate of transistor 574 to the virtual ground. As this occurs, the resistor and capacitive network 592 discharges and the gate of transistor 574 is coupled to electrical ground through the resistor pair 586,588. This causes transistor 574 to begin to conduct and decrease in impedance to the output of amplifier 560. As a result, the signal provided to the non-inverting input of the amplifier 570 is decreased and the amplitude of the output of the amplifier 570 correspondingly decreases.

The output of the amplifier 570 is input to a filter circuit 596 which includes a lowpass filter 426 and a bandpass filter 424. The lowpass filter 426 includes an operational amplifier 600 which is coupled to the output of the amplifier 570 through a resistor pair 602 and 604. Coupled to virtual ground between the resistor pair 602, 604 is a capacitor 606. Resistor 608 is coupled between the junction of resistor 602 and 604 to one side of capacitor 610 and the other side of the capacitor 610 is coupled to the inverting input of the amplifier 600. The junction of resistor 608 and capacitor 610 is coupled to the output of the amplifier 600. The values of the resistors and capacitors coupled directly and indirectly to the inverting input of the amplifier 600 are preferably selected to operate amplifier 600 as a filter having a gain of 1, a cut-off frequency 970 Hz, and a Q of 2. The slope or the roll-off, Q, from the cut-off frequency is preferably selected to be gradual to permit the lowpass filter 426 to generate a filtered signal corresponding to frequency components in the acoustical signal which approach the lower limit of the bandpass filter 424.

The bandpass filter 424 includes an operational amplifier 620 having its inverting input coupled to the output of the operational amplifier 570 through resistor 622 and capacitor 624. The junction of resistor 622 and capacitor 624 is coupled to electrical ground through resistor 626. Also coupled to the junction of resistor 622 and capacitor 624 is a capacitor 628 having one side coupled to the inverting input of the amplifier 620 through a resistor 630. The junction of the capacitor 628 and resistor 630 is coupled to the output of the amplifier 620. The resistors and capacitors coupled directly and indirectly to the inverting input of the amplifier 620 are selected so the bandpass filter 424 has a gain of approximately 1, a center frequency of 3, 410 Hz, and a Q of approximately 5. The slope or the roll-off, Q, of the bandpass filter is preferably selected to be relatively steep so the bandpass filter only outputs a filtered signal in response to an acoustical signal in the frequency range of the acoustical alarm generated by the smoke alarm module 16.

The discriminator circuit 428 determines whether a valid acoustical alarm from the smoke alarm module 16 has been received by the controller 400 and preferably, determines the type of alarm being received. Preferably, when an alarm condition is sensed, the smoke alarm module 16 sounds a 10 millisecond chirp every 40 seconds for low battery alarm, a tone of approximately 4 seconds in duration at varying intervals for a dirty filter alarm, and a comparatively continuous tone, e.g. greater than 30 seconds for a smoke alarm. The discriminator circuit 428 includes a set of comparators 640, a NAND gate 642, binary counters 516, 518, 522, a set of NOR gates 644 and a set of AND gates 646. The comparators 640 and the NAND gate 642 generate the signal indicating an alarm has been detected and that the alarm is a valid alarm signal. The counter 522, NOR gates 644, and AND gates 646 are used to distinguish between the various types of alarms. The counters 516 and 518 are used to reduce the opportunity of reporting false alarms.

In more detail, the discriminator circuit 428 has the non-inverting input of a comparator 650 coupled to the voltage derived by voltage divider 652. In a similar manner, the comparator 654 has its inverting input coupled to the output of a voltage divider 656. Preferably, the output of the voltage dividers 656, 652 is approximately one-third of the regulated voltage, but they may be chosen at other values as dictated by the acoustic environment. These voltages are provided to the comparators 650, 654 as reference voltages. The inverting input of comparator 650 is coupled to the output of the bandpass filter 424 and the non-inverting input of the comparator 654 is coupled to the output of the lowpass filter 426. In the absence of any sound, the outputs of both the bandpass filter 424 and the lowpass filter 426 will be at virtual ground of the audio circuit, i.e., V+/2.

The output of the comparator 650 generates a logic high signal whenever a signal is received from the bandpass filter 424 which is above the reference voltage on the non-inverting input and the comparator 654 outputs a logic level low signal whenever the output of the lowpass filter 426 is above the reference voltage on the inverting input. This configuration means that loud signals in the bandpass 424 cause the comparator 650 to go high and the absence of signals in the lowpass 426 cause the output of 654 to go high. The output of the comparator 650 is coupled through a diode 660 and resistor 662 to one input of NAND gate 642. The regulated voltage is coupled to the output of the comparator 650 through resistor 664 to pull up the output of the comparator 650. The parallel resistor-capacitor combination of resistor 666 and capacitor 668 is coupled to electrical ground to sustain any pulse output by the comparator 650 that is approximately 10 milliseconds in length to a pulse width of approximately 1 second in length. This resistor-capacitor combination ensures that a short acoustical alarm such as is generated to indicate a low battery condition is not missed by the circuit.

The output of the comparator 654 is coupled through resistor 670, diode 672, and resistor 674 to the other input of the NAND gate 642. A similar sustaining circuit comprised of capacitor 675 and resistor 676 is coupled between the regulated power and the output of comparator 654 at the cathode of diode 672. The regulated power is also coupled through a resistor 680 and LED 682 to the output of the NAND gate 642. NAND gate 642 is preferably a Schmitt triggered NAND gate to prevent an unstable output from the NAND gate caused by inputs to the NAND gate which fluctuate about the threshold level. When the output of the comparator 650 is a logic high to indicate a bandpass filter is present and the output of the comparator 654 is a logic high to indicate no signal is being input from the lowpass filter, the output of the NAND gate 642 goes to a logic low. This causes the LED 682 to be grounded and provides a visual indication that an alarm has been detected.

The output of the NAND gate 642 is also coupled to the inverting input of comparator 686 and to one input of the AND gate 690 for purposes to be discussed below. The non-inverting input of comparator 686 is coupled to virtual ground. Thus, when an alarm is detected, the output of the comparator 686 goes to a logic high. The output of the comparator 686 is coupled to an input of the NAND gate 476 which enables clock pulses to be provided to the clock input of the binary counter 522. The output of the comparator 686 is also sustained by the resistor-capacitor combination of resistor 692 and capacitor 694 having their output coupled through resistor 696 to the non-inverting input of comparator 700. The inverting input of the comparator 700 is coupled to virtual ground. As a result, when a valid alarm is detected and a logic high is present on the non-inverting input of the comparator 700, the output of the comparator goes high to provide a reset signal through resistor 702 to the binary counter 522.

As long as a valid alarm is detected and NAND gate 476 is enabled, clock signals are counted by the binary counter 522 and the binary count is output on the Q6 through Q12 outputs of the counter. The NOR gate 704 is coupled to the Q7, Q8, and Q9 outputs of the binary counter 522. Thus, only when each of these inputs is logic low will the output of NOR gate 704 be a logic high which enables AND gate 690. The Q6 output of the binary counter 522 is coupled to another input of the AND gate 690. The output of the NAND gate 642 is also coupled to one of the inputs of the AND gate 690 and the last input of AND gate 690 is coupled to the output of .NOR gate 708 whose output only goes high when its inputs coupled to Q10 and Q11 are at a logic low. Thus, the output of AND gate 690 only goes to a logic high when the counter has a counted a sufficient number of pulses to set Q6 output at a logic high and not a large enough number of pulses which would set high any of the Q7–Q11 outputs. Preferably, the Q6 output going high before the Q7–Q11 outputs do so corresponds to a window of approximately a half of second to less than one second, to indicate an acoustical signal having a duration of approximately that period of time has been received. As such, when the output of AND gate 690 is a logic high, a low battery alarm is indicated.

The output of AND gate 690 is coupled through resistor 710 to the clock input of a counter 516. Counter 516 is configured so the Q6 output of the counter is coupled through a resistor 712 and the diode of the opto-coupler 714 to the anode of a LED 716 having its cathode coupled to electrical ground. The Q6 output of the counter is also coupled to the clock input of the counter through a diode 720. After counter 516 counts $2^6$ or 64 acoustical signals, such as an alarm or randomly occurring signal such as a "pop" or "click", the Q6 output goes to a logic high to drive the transistor of the opto-coupler 714 and light the LED 716. The low battery event occurring with regularity at 40 seconds intervals dominates such counting and minimizes the chances a low battery condition is falsely indicated. The opto-coupler 714 may be used to perform some other control action for the furnace in response to the low battery alarm. The output of a logic high on the Q6 output of the counter 516 forward biases the diode 720 to hold the clock input at a logic high and thus the counter 516 no longer counts battery alarms. This prevents the counter 516 from continuing to count and roll over which would disable the low battery control action.

Still with reference to FIG. 10, AND gate 726 preferably operates in a similar manner to provide a control action for a dirty filter indication. Specifically, one input of the AND gate 726 is coupled to the output of NOR gate 708. Another input of AND gate 726 is coupled the Q9 output of the counter 522. Another input of AND gate 726 is coupled to the output of NAND gate 642 and the remaining input of AND gate 726 is coupled to a logic high. As a consequence, the output of AND gate 726 only goes to a logic high when the counter 522 has counted a sufficient number of pulses when the Q9 output is a logic high and the Q10, Q11 outputs are a logic low. Preferably, the Q9 output going high before the Q10, Q11 outputs do so corresponds to a window approximately greater than 4 seconds and less than 8 seconds to indicate an acoustical signal of that duration has been received. Preferably, when the output of the AND gate 726 is a logic high, an air cleaner functional alarm is indicated.

The output of the AND gate 726 is coupled through resistor 730 to the clock input of counter 518. The Q2 output of the counter 518 is coupled through a resistor 732, opto-coupler 734, and LED 736 in a manner similar to that discussed with respect to the counter 516. The Q2 output of the counter 518 is also coupled through a diode 740 to the clock input of the counter 518. Thus, the counter 518 is configured in a manner like that of counter 516. Thus, the counter 518 preferably counts $2^2$ or 4 air cleaner functional alarms before initiating a control action through opto-coupler 734. A lower number of counts is required to minimize false alarms for dirty filters because the relatively long (4 second) duration is more distinct from its environment than is the low battery alarm short duration.

In the event the smoke alarm module 16 sounds a smoke alarm which is preferably continuous, the output of the NAND gate 642 remains a logic low and counter 522 continues to count clock pulses from NAND gate 476. As the count of clock pulses accumulates, the Q12 output of the counter 522 goes to a logic high to disable the coupling of electrical ground to the coil 432 through transistor 446. This action causes the contacts 444 to open and power to the control portion of furnace is terminated. The presence of a logic high on Q12 also turns on transistor 524 which couples electrical the cathodes of the diodes 74 1, 742 which disable the clock pulses and counter 522 reset, respectively.

Figure 6:
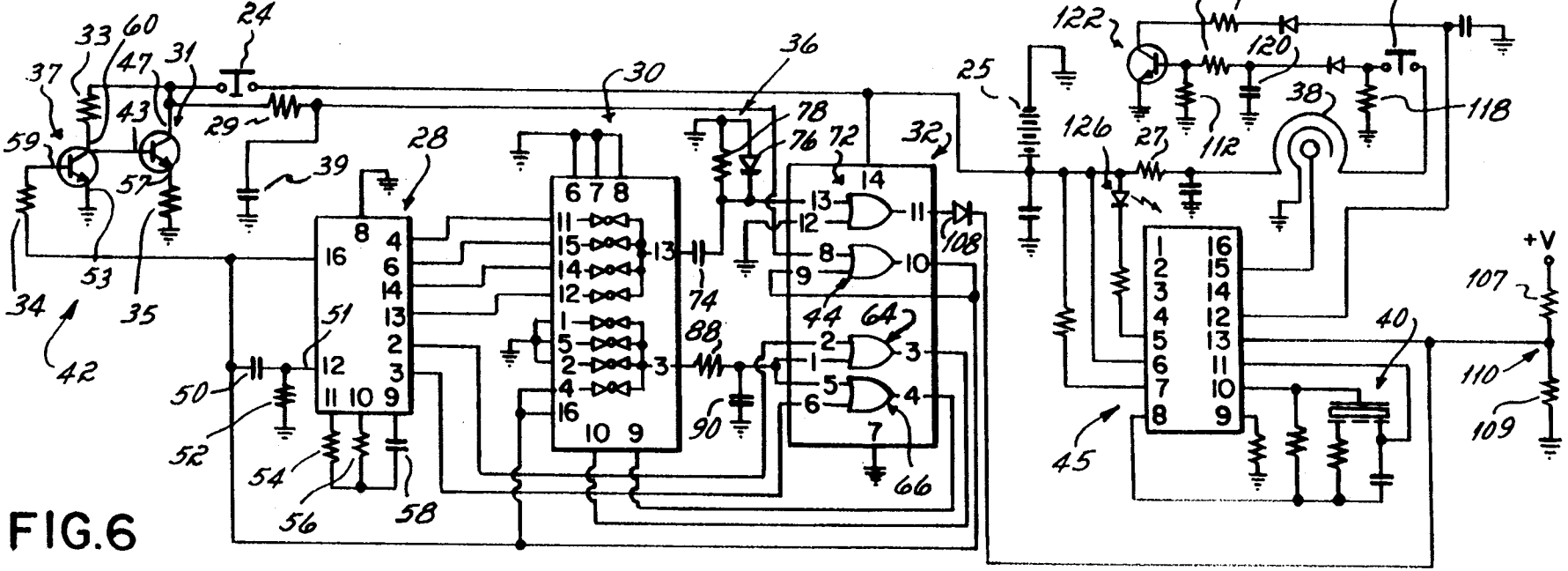
FIG. 6 is an electrical schematic diagram of the components used in the preferred embodiment of the present invention.

A schematic diagram of the electrical components in the preferred embodiment of the present invention is shown in FIG. 6. Battery 25 is connected to input power pin 6 of smoke alarm integrated circuit (IC) 45; to pressure differential switch 24; logic gates 32; and to sensor 38 via resistor 27. Switch 24 selectively connects power through resistor 33 to collector 47 and base 43 of transistor 31. Collector 47 is connected through resistor 29 to input pin 8 of logic gate 44. Resistor 29 and capacitor 39, connected between the low potential side of resistor 29 and ground, absorb any signals from switch 24 caused by transient closings. The output of gate 44 is provided to input pin 9 to latch the closed switch signal through the gate. This signal provides counter 28 and multiplexer 30 with electrical power. capacitor 50 and resistor 52 are connected to the output of gate 44 to provide a delayed reset pulse to reset input 51 of counter 28.

The output of gate 44 is also tied to base 59 of transistor 37 through resistor 34. Transistor 37 has its emitter 53 grounded and its collector 60 tied to the low potential of resistor 33. The output of gate 44 turns on transistor 37 to remove the voltage on the base of transistor 31 that turns off transistor 31. The current drain on battery 25 is much lower through transistor 37 than transistor 31 since resistor 33 is several orders of magnitude greater than resistor 35. In the preferred embodiment of the invention, resistor 33 is 1 megohm and resistor 35 is 100 ohms, although other values may be used.

In the preferred embodiment of the present invention, counter/oscillator 28 is a CD14060 manufactured by Motorola of Phoenix, Ariz., although other similar devices could be used. Resistors 54, 56 and capacitor 58 are connected to counter 28 to control the frequency of the timing signal generated by the internal oscillator of counter 28. Output pins 4, 6, 14 and 13 of the counter which count the timing signal within counter 28 are connected to input pins 11, 15, 14 and 12, respectively, of multiplexer 30. Output pins 2 and 3 of the counter are connected to input pins 2 and 6, respectively, of OR gates 64 and 66, respectively, of the quad OR gate logic circuit. In the preferred embodiment of the present invention, multiplexer 30 is a CD14052 and logic circuit 32 is a CD14071, both produced by Motorola of Phoenix, Ariz. The three components 28, 30 and 32 are all CMOS devices in the preferred embodiment of the present invention to take advantage of the low power consumption of such devices and to provide logical compatibility with the CMOS smoke alarm IC in the preferred embodiment.

Multiplexer 30 has two 4 to 1 channels with input pins 1, 5, and 2 of the second channel connected to ground and pins 4 and 16 are connected to output pin 10 of logic gate 44. Input pins 11, 12, 14, and 15 of the first channel are tied to the output of counter 28 as disclosed above. Output 13 of the first channel is connected to input pin 13 of OR gate 72 through capacitor 74 of timer control 36. Diode 76 and resistor 78 ground the line between capacitor 74 and input pin 13. Output pin 3 of the second multiplexer channel is connected to input pins 1 and 5 of gates 64, 66, respectively, through resistor 88. Capacitor 90 connects the line between resistor 88 and gate input pins 1 and 5 to ground. Gate input pin 12 is tied to ground to improve electrical noise immunity.

Output pins 3 and 4 of gates 64, 66 are tied to the input channel select pins 10 and 9 of multiplexer 30 to control the input channel selection as explained below. Output pin 11 of gate 72 is connected via diode 108 to voltage divider 110 which provides the smoke reference voltage to alarm IC 45. The remaining components connected to alarm IC 45 interface the alarm IC to alarm generator 40 and smoke sensor 38. The circuit comprised of resistors 112, 114, 116 and 118, capacitor 120, transistor 122, and momentary switch 124 is for manually testing the smoke detector. Likewise, LED 126 is connected to alarm IC 45 to provide a test load for battery 25 and a visual indication that alarm IC 45 is periodically performing the battery test.

The electronics are powered by battery 25 which drives smoke alarm IC 45 and logic gates 32 directly and provides the operational power for counter 28 and multiplexer 30 through gate 44. As previously discussed, switch 24 closes when the pressure difference monitored by the switch exceeds the predetermined threshold to provide an activating current to base 43 of transistor 31 through resistor 33. Switch 24 also provides a voltage on collector 47. Since the voltage at base 43 is dropped across resistor 33 and emitter 57 is tied to ground through the relatively low resistance of resistor 35, the base to emitter voltage is forward biased and the base to collector is reverse biased causing transistor 31 to conduct current from the collector to the emitter. Resistor 35 is sized sufficiently small to pull a large enough current through the contacts of switch 24 to burn through any oxidation that may accumulate on the contacts. In the preferred embodiment of the present invention, the current pulled through the switch contacts is 10 ma.

Part of the current at collector 47 charges capacitor 39 through resistor 29. When capacitor 39 is sufficiently charged, input pin 8 of OR gate 44 goes high and output 10 is driven high. The output of gate 44 is fed to input pin 9 to latch the switch signal. Output 10 now remains high and supplies power to counter/oscillator 28 and multiplexer 30. Resistor 29 and capacitor 39 require the signal from switch 24 to be present for at least one charging period of capacitor 39 through resistor 29. In the preferred embodiment of the invention, the minimum time period is 6.8 seconds. If the pressure differential drops below the threshold before capacitor 39 is charged, input pin 8 does not go high and turn on output pin 10 of gate 44 to power components 28 and 30. The resistor, capacitor combination prevents false alarms from transient blockage of switch 24.

Once output 10 is high, a voltage is dropped across resistor 34 to base 59 of transistor 37 causing transistor 37 to conduct the voltage dropped across resistor 33 at collector 60 to the ground connection at emitter 53. This conduction removes the base current from base 43 and transistor 31 turns off. Current is now conducted through the relatively high resistance of resistor 33 to the ground connection at emitter 53 and the current through switch 24 drops to a level substantially less than the initial current drawn by transistor 37. The reduction in current through switch 24 preserves the capacity of battery 25 and increases its operational life.

The battery power is also supplied to the reset 51 on counter 28 through capacitor 50. When power is first applied to capacitor 50, it acts as an electrical short and the battery voltage is present on reset 51. As capacitor 50 accumulates charge, the voltage on reset 51 drops to a logic low. The high to low transition on reset 51 resets counter 28. The RC time constant of resistor 52 and capacitor 50 is such that counter 28 resets after the other components have settled to their initial state after power up. Once counter 28 is powered on and its internal oscillator begins to operate, the timing of the oscillator is determined by external resistors 54, resistor 56 and capacitor 58. In the preferred embodiment, these components are selected to produce counts the generated timing signal to produce a binary output count, $Q_1$–$Q_{14}$ with $Q_1$ being the least significant binary digit. In the preferred embodiment of the present invention, $Q_6$, $Q_7$, $Q_8$ and $Q_9$ are provided on output pins 4, 6, 14 and 13 of counter 28 and represent, respectively, the one hour, two hour, four hour, and eight hour timing counts. These four lines are input to the first channel of multiplexer 30 which selects one of the four lines according to the status of control input pins 10 and 9.

Following power-up, output pins 3 and 4 of gates 64, 66 are logically low and channels one and two of multiplexer 30 pass the inputs on pins 12 and 1, respectively, to the channel outputs. Since pin 12 is connected to output pin 13, output pin 13 of channel one is a logic low for the first 8 hours following switch 24 closure and then is a logic high for the next 8 hours. When output pin 13 first goes high, capacitor 74 acts as an electrical short and the logic high of output pin 13 drives output pin 11 of gate 72 high. As capacitor 74 charges, the voltage at input pin 13 drops until it falls below the threshold of gate 72 and output pin 11 falls to a logic low. The values of resistor 78 and capacitor 74 determine the time it takes capacitor 74 to charge and thus the period that output pin 11 of gate 72 remains high. In the preferred embodiment of the present invention, this timing period is approximately 2.5 seconds.

During this period, the voltage from output pin 11 is presented to the reference voltage input of alarm IC 45. This voltage raises the reference voltage to a value that is very nearly the voltage that alarm IC 45 receives from sensor 38. These voltages are close enough that the voltage comparator within alarm IC 45 generates an alarm signal to drive alarm generator 40 for the pulse period. Once output pin 11 of gate 72 drops, the reference voltage returns to the voltage present between resistor 107, 109 of voltage divider 110 which is substantially less than the voltage from sensor 38 when no smoke is present. Unless smoke has altered the voltage output by sensor 38, the voltage comparator of alarm IC 45 no longer generates the alarm signal.

After counter 28 has counted another 8 hours, output pin 13 of multiplexer 30 follows output pin 13 of counter 28 and drops low. This causes capacitor 74 to discharge through resistor 78 which presents a pulse to input pin 13 of gate 72. This pulse again causes alarm IC 45 to drive alarm generator 40 for the duration of the period to produce an alarm. Thus, an alarm is produced by generator 40 every 8 hours. This periodic alarm continues until output pin 2 of counter 28 goes high. As pin 2 goes high so does input pin 2 of gate 64 which drives its output pin 3 and channel select pin 10 high. This causes multiplexer 30 to select channel input pins 14 and 5 for channels 1 and 2, respectively. Since pin 5 is grounded, the outputs of gates 64, 66 remain unaffected and the channel select lines remain the same. The change of channel 1 input to pin 14 causes output pin 13 to follow counter output pin 14 which has a frequency one-half that of counter pin 13. This causes alarm generator 40 to alarm for the duration of the pulse from output pin 11 of gate 72 every 4 hours. The doubling of the alarm frequency indicates that the cleaner 12 continues to deteriorate and provides an increased urgency for its remedial maintenance.

The 4 hour periodic alarms continue for another 128 hours until counter output pin 2 goes low and counter pin 3 goes high. This transition occurs as counter 28 continues to count the internal timing signal. Pin 2 dropping low causes output pin 3 of gate 64 to drop low and pin 3 going high causes output pin 4 of gate 66 to go high. This change on channel 5 select pins 10, 9 moves the input channel select for channel 1 to pin 15 and for channel 2 to pin 2. Because multiplexer pin 2 is grounded, channel select pins 10, 9 are unaffected. Connecting input pin 15 to channel 1 output pin 13 makes pin 13 follow output pin 6 of counter 28 which is one half the frequency of pin 14. Smoke alarm IC 45, consequently, drives alarm generator 40 every two hours to further provide a more urgent indicator that cleaner 12 needs servicing.

At the conclusion of another 128 hour period, pin 2 of counter 28 goes high. With both pin 2 and 3 high, gates 64, 66 both produce logic highs on output pins 3 and 4 to drive channel select pins 10, 9 high. Channels 1 and 2 now pass pins 11 and 4 respectively. Pin 4 is tied to the supply voltage and is shunted to ground through resistor 88 at first because capacitor 90 acts as an electrical short. After, capacitor 90 charges, the battery voltage remains at input pins 1 and 5 of gates 64, 66 to keep output pins 3 and 4 high. This remains true even though counter output pins 2 and 3 go to a logic low at the end of the next 128 hour period causing gate input pins 1 and 5 to go low. However, gate output pins 3 and 4 remain high because input pins 1 and 5 are held high by output pin 3 on the output of channel 2. Thus, channels 1 and 2 remain connected to input pins 11 and 4. Pin 11 is connected to counter output pin 4 which has a frequency onehalf of pin 6. The appearance output of pin 4 on the channel 1 output causes alarm generator 40 to alarm for the duration of the pulse every hour. Because channel one remains connected to pin 4 of counter 28, the 1 hour periodic alarms continue indefinitely. After servicing cleaner 12, the counting circuit may be reset by disconnecting and reconnecting the battery.

Figure 11:
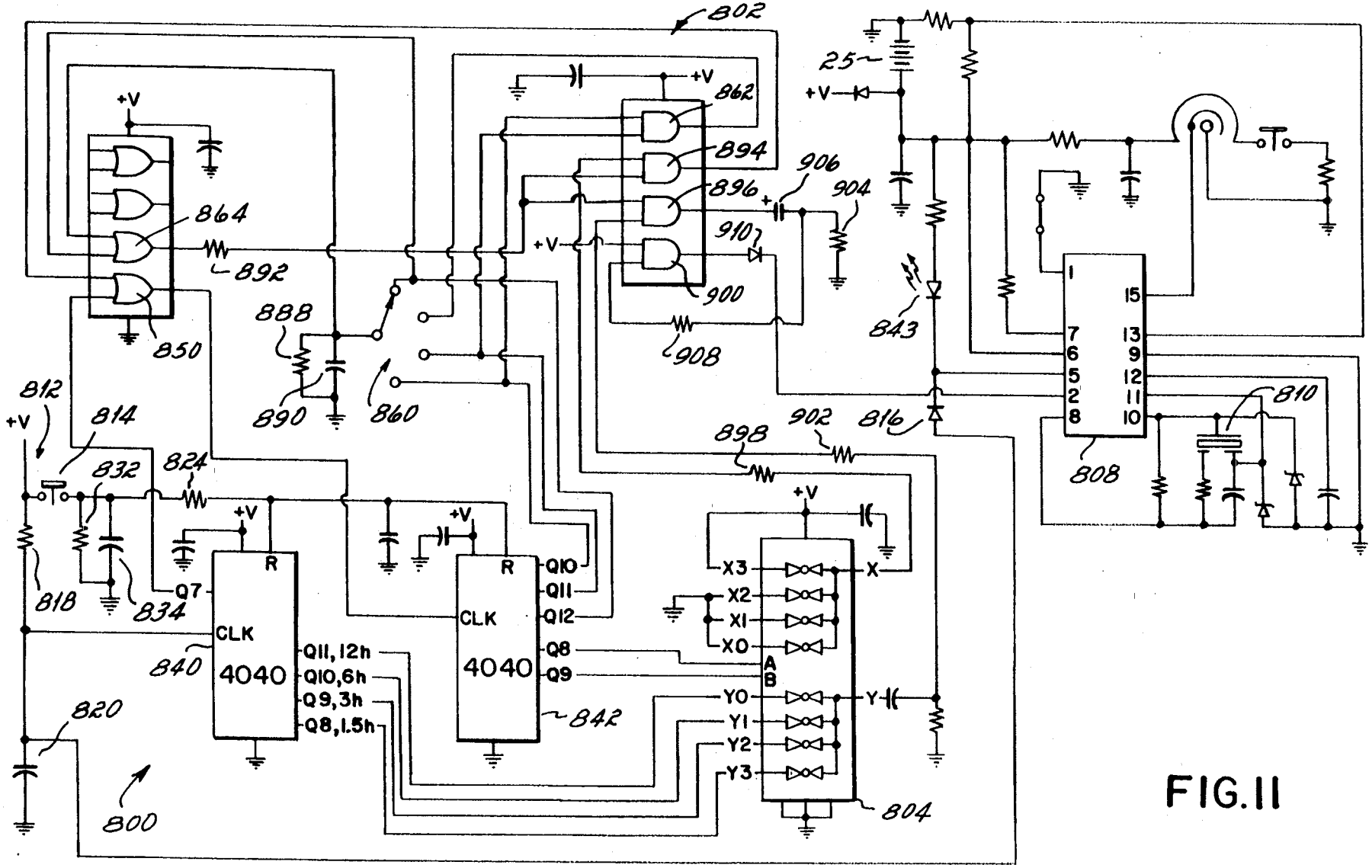
FIG. 11 is an electrical schematic diagram of an embodiment of a functionality detector that operates in a tinned manner in accordance with the principle of the present invention.

Another embodiment which provides the functionality detector and smoke alarm unit of the present invention is shown in FIG. 11. The functionality detector of this embodiment differs from the embodiment previously discussed in that an alarm for indicating to a user that the air cleaner needs servicing is generated after a predetermined time period has elapsed from installation of the air cleaner rather than from a sensed condition of the air flow through the air cleaner. This embodiment includes a timing circuit 800 and a timing control circuit 802 both of which interface with a multiplexer 804 which is of the same type as the multiplexer 30 discussed in the previous embodiment. The timing control circuit 802 generates a service signal at its output to pin 2 of the smoke alarm IC 808 which drives the piezo electric buzzer 810 to sound a air cleaner service alarm. In the embodiment of FIG. 11, smoke alarm IC 808 is manufactured by Motorola and designated by part No. MC14468. All of the components coupled to the smoke alarm IC 808 are substantially the same as those coupled to the IC 45 in the embodiment shown in FIG. 6. For this reason, this interface shall not be discussed further. Of primary importance in the embodiment depicted in FIG. 11 is the generation of the service alarm signal.

The timing circuit 802 shown in FIG. 11 includes a reset circuit 812. The reset circuit 812 includes a momentary switch 814 which is coupled to the battery 25 through diode 816 and resistor 818. Capacitor 820 is coupled between diode 816 and resistor 818 to reduce high frequency transient noise. The other side of the momentary switch 814 is coupled through resistor 824 to the reset inputs of counters 840 and 842. The parallel resistor-capacitor combination of resistor 832 and capacitor 834 coupled between resistor 824, switch 814 and electrical ground preferably ensures a reset pulse width of one-tenth of a second. The clock input of counter 840 is coupled to pin 5 of the smoke alarm IC. Pin 5 of the smoke alarm IC preferably grounds the cathode of LED 843 periodically, which is preferably a period of every 40 seconds. Thus, after the reset switch is depressed to reset the counters, counter 840 begins counting the clock pulses provided at its input. The output of the counter 840 is provided on the Q outputs in a binary format.

The Q7 output of the counter 840 shown in FIG. 11 is provided to one input of the OR gate 850. When Q7 goes to a logic high, the output of 0R gate 850 goes high and outputs a logic high to the clock input of the counter 842. As a consequence, every $2^7$ or 128 pulses of the clock from pin 5 of the smoke alarm IC causes a change in the logic level of the clock signal to the counter 842. The Q8 and Q9 outputs of the counter 842 are coupled to the channel selection inputs of the multiplexer 804. As counter 842 continues counting the pulses provided through OR gate 850, the outputs of the multiplexer are varied. The X0, X1 and X2 inputs of the multiplexer are coupled to electrical ground and the X3 input of the multiplexer is coupled to the battery 25. Inputs Y0, Y1, Y2, and Y3 are coupled to the Q11, Q10, Q9, and Q8 outputs of the counter 840.

The Q10 output of the counter 842 is coupled to one connection of a multi-position switch 860 and to one input of AND gate 862. The Q11 output of the counter 842 is coupled to another connection of the multi-position switch 860 and to the other input of the AND gate 862. The Q12 output of the counter 842 is coupled to another connection of the multi-position switch 860 and to one input of the OR gate 864. The output of the AND gate 862 is coupled to the remaining connection of the multi-position switch 860. The logic signal at each of the connections of the multi-position switch 860 correspond to a different elapsed time the user may select for activation of the air cleaner service alarm. Preferably, the connection coupled to Q10 corresponds to approximately thirty days (30), the connection coupled to Q11 corresponds to approximately sixty days (60), the connection coupled to the output of AND gate 862 corresponds to approximately ninety days (90), and the connection coupled to Q12 corresponds to approximately a hundred and twenty days (120). The Q12 output is coupled to the input of OR gate 864 as a default time period should switch 860 fail.

The output of selectable switch 860 is coupled to a resistor-capacitor combination of resistor 888 and capacitor 890 which sustain the pulse coupled through the switch 860. The output of the switch 860 is also coupled to an input of the OR gate 864. The output of OR gate 864 is coupled through resistor 892 to one input of the AND gate 894 and AND gate 896. The X channel output of the multiplexer 804 is coupled through resistor 898 to one input of AND gate 894 and the Y channel output of the multiplexer 804 is coupled through resistor 902 to one input of AND gate 896. The output of gate 896 is coupled through capacitor 906 and resistor 908 to one input of AND gate 900. Coupled to electrical ground between the junction of the capacitor 906 and resistor 908 is a resistor 904. The function of the resistors 908, 904 and capacitor 906 is discussed below.

When the output states of Q8, Q9 of counter 840 are such that X3 and Y3 are selected for output on the X channel and Y channel outputs of the multiplexer 804, the output of AND gate 894 goes to a logic high if the elapsed time has expired which was selected in switch 860. This causes the output of OR gate 850 to go to a logic high which holds the clock input to counter 842 at a logic high. This effectively freezes the output states of the counter 842 which also freezes the channel selections for the X and Y channels of the multiplexer 804 to X3 and Y3, respectively. Because Y3 is coupled to Q8 of the counter 840, a logic high is output at the Y channel output of the multiplexer 804 in accordance with the counting of the clock signal from pin 5 of the IC 808. The positive level output by the Y channel of the multiplexer drives the output of gate 896 high since the output of OR gate 846 is a logic high as a result of the elapsed time period corresponding to the setting of switch 860. The output of AND gate 896 is coupled to an input of AND gate 900 through a capacitor 906 and a resistors 908, 904. Because the other input of AND gate 900 is coupled to a logic high, the output of gate 900 follows the output of gate 896. A logic high from gate 896 is differentiated by the capacitor-resistor network coupled between gates 896 and 900 so a positive going pulse is generated and coupled through diode 910 to the input at pin 2 of the smoke alarm IC. The values of the resistors and capacitor in the capacitor-resistor network are preferably selected to produce a pulse of approximately 4 seconds. This pulse causes the smoke alarm IC to drive the piezo electric buzzer and generate an audible alarm indicating the air cleaner needs servicing.

While the present invention has been illustrated by the description of the preferred embodiment and while the preferred embodiment has been described in considerable detail, it is not the intention of the applicant to restrict or any way limit the scope of the appended claims to such detail. Additional advantages and modifications will readily appear to those skilled in the art. The invention in its broader aspects is therefore not limited to the specific details, representative apparatus, and illustrative examples shown and described. Accordingly, departures may be made from such details without departing from the scope or spirit of applicant's general inventive concept.

What is claimed is:

1. A module for integrating a functionality detector and a smoke detector within an air cleaner, said module comprising:

a housing having a receptacle in which said functionality detector, said smoke detector and a power source are mounted, said housing having a front surface, a rear surface, and an edge interposed between said front and rear surfaces;

an air flow path extending into said housing from said air cleaner to said receptacle for providing an air sample to said smoke detector; and means operatively connected to said housing for reducing airflow velocity within said air flow path before said air flow enters said receptacle whereby said air sample is provided to said smoke detector at a velocity effective for detecting smoke.

2. The module of claim 1 further comprising:

a mounting sleeve for mounting said housing within a frame of the air cleaner, said mounting sleeve having a front surface and a rear surface, a front flange extending from said front surface of said sleeve; and a rear flange extending from said rear surface of said sleeve, said rear flange extending further from said rear surface of said sleeve than said front flange extends from said front surface of said sleeve so that air flowing by said front flange is blocked by said rear flange to reduce airflow velocity in the vicinity of the airflow velocity reducing means.

3. The sleeve of claim 2 wherein said airflow velocity reducing means being incorporated in said sleeve so that said sleeve provides at least a portion Of Said air flow path for air flowing from said air cleaner to said smoke detector in said housing.

4. The housing of claim I said airflow velocity reducing means further comprising:

a stall chamber for reducing airflow velocity, said stall chamber forming part of said airflow path and having an inlet in communication with said air cleaner.

5. The module of claim 4, said airflow velocity reducing means further comprising:

an expansion chamber having a volume greater than said stall chamber to reduce airflow velocity of air entering said expansion chamber from said stall chamber; and a bridge separating said expansion chamber from said stall chamber, said bridge having a plurality passageways formed therein to reduce the pressure differential between said expansion chamber and said stall chamber.

6. The housing of claim 5 wherein said passageways are larger in diameter than said inlet to said stall chamber.

7. The housing of claim 5 wherein said passageways are U-shaped grooves.

8. The module of claim 2, said sleeve further comprising:

a key formed between said front surface and said rear surface; and said housing having a slot formed therein to receive said key whereby said key prevents said housing from being mounted in said sleeve incorrectly and said key resets electronics mounted within said receptacle of said housing.

9. A furnace controller for responding to an acoustical alarm from an alarm unit associated with a forced recirculating air system, the alarm unit generating the acoustical alarm in response to a sensed condition of the recirculating air system comprising:

means for sensing an acoustical signal;

means for converting a sensed acoustical signal to an electrical signal;

means for determining whether said electrical signal corresponds to the acoustical alarm generated by the alarm unit; and means for controlling the furnace in response to said determining means determining that said electrical signal corresponds to the acoustical alarm from the alarm unit.

10. The controller of claim 9, said determining means further comprising:

means for filtering said electrical signal so that said filtered electrical signal has an amplitude that corresponds to an amplitude of frequency components within a sensed acoustical signal, said frequency components being in a predetermined range; and means for generating an alarm signal in response to said filtered electrical signal having an amplitude above a predetermined threshold, said alarm signal being coupled to said controlling means.

11. The controller of claim 10, said filtering means further comprising:

means for separating said electrical signal into a first filtered electrical signal and a second filtered electrical signal, said first filtered electrical signal having an amplitude that corresponds to said frequency components within said sensed acoustical signal, said frequency components being in said predetermined range and said second filtered electrical signal having an amplitude that corresponds to frequency components within said sensed acoustical signal, said frequency components being below a predetermined frequency;

means for detecting said first and said second filtered signals, said detecting means generating a signal indicative of which of said first and second filtered signals are greater than said predetermined threshold; and said alarm signal generating means generating said alarm signal in response to a signal indicative of said first filtered electrical signal being detected and said second filtered electrical signal not being detected.

12. The controller of claim 10, said filtering means further comprising:

means for generating said filtered electrical signal with a duration corresponding to a duration of said sensed acoustical signal in said frequency range;

means for generating a first alarm signal in response to said filtered electrical signal having a first duration and a second alarm signal in response to said filtered electrical signal having a second duration; and said controlling means performing a first control action in response to said first alarm signal and a second control action in response to said second alarm signal.

13. An integrated air cleaner and air quality alarm unit for installation in a recirculating forced air system comprising:

means for cleaning the air flowing within the system;

a functionality detector for detecting a functional degradation of said air cleaning means, said functionality detector generating a service signal in response to detecting said functional degradation of said air cleaning means;

a sensor for detecting one of a particulate and a gas in the air flowing within the system, said sensor generating a signal in response to detecting said one of said particulate and said gas; and an alarm generator for generating an alarm in response to one of said service signal from said functionality detector or said signal from said sensor.

14. The unit of claim 13 wherein said alarm generator generates an alarm in response to said signal from said sensor that is distinguishable from an alarm generated in response to said service signal from said functionality detector.

15. The unit of claim 13, said sensor being one of a carbon monoxide detector, a radon detector, and a natural gas detector.

16. The unit of claim 13, said functionality detector comprising:

timing means for timing a predetermined time period, said timing means generating said service signal in response to expiration of said predetermined time period.

17. The unit of claim 16, said timing means furthering comprising:

defining means for defining said predetermined time period.

18. The unit of claim 17, said defining means further comprising:

selecting means for selecting said predetermined time period from a plurality of predetermined time periods.

19. The unit of claim 16, said timing means further comprising:

alarm timing means for timing an alarm time period, said alarm timing means generating an alarm time signal in response to the expiration of said alarm time period, said timing means generating said service signal in response to said alarm time signal.

20. The unit of claim 19, said alarm timing means repetitively timing said alarm time period and generating said alarm time signal.

21. The unit of claim 13, said functionality detector further comprising:

a pressure differential sensor for measuring a pressure differential across said air cleaning means;

detector means for reading a plurality of said pressure differential measurements and calculating an average of said plurality of readings to establish a reference pressure differential, said detector means adding a predetermined pressure differential to said reference pressure to establish a pressure differential threshold; and a memory element for storing said pressure differential threshold so that said detector means generates said service signal in response to said pressure differential read from said sensor being greater than said stored pressure differential.

22. A controller for a heating appliance, said controller adapted to respond to an acoustical alarm from an alarm unit associated with said heating appliance, the alarm unit generating the acoustical alarm in response to a sensed condition of the heating appliance, wherein the controller comprises:

means for sensing an acoustical signal;

means for converting a sensed acoustical signal to an electrical signal;

means for determining whether said electrical signal corresponds to the acoustical alarm generated by the alarm unit; and means for controlling the heating appliance in response to said determining means determining that said electrical signal corresponds to the acoustical alarm from the alarm unit.

23. The controller of claim 22, said determining means further comprising:

means for filtering said electrical signal so that said filtered electrical signal has an amplitude that corresponds to an amplitude of frequency components within a sensed acoustical signal, said frequency components being in a predetermined range; and means for generating an alarm signal in response to said filtered electrical signal having an amplitude above a predetermined threshold, said alarm signal being coupled to said controlling means.

24. The controller of claim 23, said filtering means further comprising:

means for separating said electrical signal into a first filtered electrical signal and a second filtered electrical signal, said first filtered electrical signal having an amplitude that corresponds to said frequency components within said sensed acoustical signal, said frequency components being in said predetermined range and said second filtered electrical signal having an amplitude that corresponds to frequency components within said sensed acoustical signal, said frequency components being below a predetermined frequency;

means for detecting said first and said second filtered signals, said detecting means generating a signal indicative of which of said first and second filtered signals are greater than said predetermined threshold; and said alarm signal generating means generating said alarm signal in response to a signal indicative of said first filtered electrical signal being detected and said second filtered electrical signal not being detected.

25. The controller of claim 23, said filtering means further comprising:

means for generating said filtered electrical signal with a duration corresponding to a duration of said sensed acoustical signal in said frequency range;

means for generating a first alarm signal in response to said filtered electrical signal having a first duration and a second alarm signal in response to said filtered electrical signal having a second duration; and said controlling means performing a first control action in response to said first alarm signal and a second control action in response to said second alarm signal.

* * * * *